US008985349B2

(12) United States Patent
Stenhouse

(10) Patent No.: US 8,985,349 B2
(45) Date of Patent: Mar. 24, 2015

(54) CORNER SHELF SYSTEM FOR STORING AND DISPLAYING CONSUMER ELECTRONIC SOURCE COMPONENTS

(71) Applicant: MW Products LLC, Phoenix, AZ (US)

(72) Inventor: Brett Stenhouse, Phoenix, AZ (US)

(73) Assignee: MW Products LLC, Phoenix, AZ (US)

( * ) Notice: Subject to any disclaimer, the term of this patent is extended or adjusted under 35 U.S.C. 154(b) by 0 days.

(21) Appl. No.: 14/155,195

(22) Filed: Jan. 14, 2014

(65) Prior Publication Data

US 2014/0197119 A1 Jul. 17, 2014

Related U.S. Application Data

(60) Provisional application No. 61/753,317, filed on Jan. 16, 2013.

(51) Int. Cl.
*A47F 5/08* (2006.01)
*A47B 96/02* (2006.01)

(52) U.S. Cl.
CPC ..... *A47B 96/022* (2013.01)
USPC ..... 211/90.01; 248/220.1

(58) Field of Classification Search
CPC .. A47B 96/022; A47B 96/024; A47B 96/025; A47B 96/06; A47B 96/063
USPC ..... 211/90.01, 90.02; 108/147.11, 147.13, 108/147.14, 147.17; 248/220.21, 220.22, 248/250, 220.1; 403/91–102
See application file for complete search history.

(56) References Cited

U.S. PATENT DOCUMENTS

| | | | | | |
|---|---|---|---|---|---|
| 622,490 | A | * | 4/1899 | Kelly | 74/551.4 |
| 975,619 | A | * | 11/1910 | Hollander | 108/42 |
| 1,159,813 | A | * | 11/1915 | Volkhardt | 211/104 |
| 1,286,588 | A | * | 12/1918 | Goodykoontz | 108/28 |
| 1,325,143 | A | * | 12/1919 | Conterio | 108/42 |
| 1,654,409 | A | * | 12/1927 | Browne | 108/29 |
| 2,219,975 | A | * | 10/1940 | Bentz | 248/220.1 |
| 2,465,635 | A | * | 3/1949 | Conterio | 108/42 |
| 4,555,082 | A | * | 11/1985 | Sack et al. | 248/220.1 |
| 4,776,471 | A | * | 10/1988 | Elkins | 211/64 |
| 4,886,236 | A | * | 12/1989 | Randall | 248/250 |
| D313,720 | S | * | 1/1991 | Sorenson et al. | D6/574 |
| 5,154,384 | A | * | 10/1992 | Owens | 248/220.1 |
| 5,513,575 | A | * | 5/1996 | Slade | 108/42 |
| 6,565,156 | B1 | * | 5/2003 | Yamashita et al. | 297/354.12 |
| 8,225,435 | B2 | * | 7/2012 | Kik et al. | 4/578.1 |
| 2003/0226815 | A1 | * | 12/2003 | Gaunt et al. | 211/153 |
| 2005/0040124 | A1 | * | 2/2005 | Fontana et al. | 211/90.01 |
| 2008/0224004 | A1 | * | 9/2008 | Gallien | 248/220.1 |
| 2011/0168859 | A1 | * | 7/2011 | Baruch | 248/241 |
| 2013/0228541 | A1 | * | 9/2013 | O'Hara | 211/134 |

FOREIGN PATENT DOCUMENTS

| | | | | | |
|---|---|---|---|---|---|
| DE | 10209092 | A1 | * | 9/2003 | A47B 47/03 |
| GB | 2078099 | A | * | 1/1982 | A47B 96/06 |
| GB | 2232345 | A | * | 12/1990 | A47B 96/06 |

* cited by examiner

*Primary Examiner* — Joshua Rodden
(74) *Attorney, Agent, or Firm* — Lewis Roca Rothgerber LLP

(57) ABSTRACT

A corner shelf system may include a support assembly and a shelf. The support assembly may include at least two support members coupled at about a 90° angle. The support members may be coupled together by a ratchet mechanism. The about 90° angle at which the support members are coupled may be adjustable by way of the ratchet mechanism. At least two of the support members may each include a channel that slideably receives an edge of the shelf.

20 Claims, 5 Drawing Sheets

CORNER SHELF SYSTEM FOR STORING AND DISPLAYING CONSUMER ELECTRONIC SOURCE COMPONENTS

CROSS-REFERENCE TO RELATED APPLICATION

This application claims the priority benefit of U.S. provisional application 61/753,317 filed Jan. 16, 2013, the disclosure of which is incorporated herein by reference.

BACKGROUND

1. Field of the Disclosure

The present disclosure concerns shelving. More particularly, the present disclosure concerns a corner shelf system for storing and displaying consumer electronic source components and other objects.

2. Description of the Related Art

Flat panel displays have become increasingly popular over the past two decades. Nearly all flat panel displays are accompanied by and connected to at least one source component, such as a piece of audio, video, or gaming equipment. As a result, successfully mounting a flat panel to a wall often accounts for only half the overall installation task. The remaining challenge concerns where and how to store the one or more source components in a way that is easy to accomplish and provides an aesthetically pleasing result. Many flat panel displays are mounted flat against a single wall. In such cases, one traditional solution for storing source components is to install a rectangular shelf on the same wall to which the flat panel display is mounted.

Notably, however, not all flat panel displays are mounted flat against a single wall. On the contrary, many consumers choose to mount their flat panel displays in the corner of a room. Despite that fact, the shelving market has lagged in offering consumers an easy-to-install corner shelf system that can reliably support and elegantly display source components connected to corner-mounted flat display panels. Traditional shelves designed for single walls have proven inadequate because they attach to only a single stud and cannot remain fixed within a corner. Existing shelves designed for corners are similarly inadequate because they are limited to supporting small objects like picture frames, candles, and trinkets. Such shelves lack the mechanical integrity necessary to support modern consumer electronic equipment such as set-top boxes, gaming systems, stereo receives, and optical disc players.

Lacking any suitable alternative, many consumers simply install traditional single-wall shelves flat against one of the two walls leading into the corner. The result, however, is an asymmetrical and aesthetically unappealing arrangement in which the shelf displaying the source components is offset from the corner-mounted flat panel. Aside from the aesthetic disadvantages, the offset nature of such arrangements can create line of site problems for users attempting to control both a corner-mounted flat panel and the accompanying source components with an infrared remote control device. Given such limitations, there is a need among consumers for an easy-to-install corner shelf system that can reliably support and elegantly display source components connected to corner-mounted flat display panels.

SUMMARY OF THE CLAIMED INVENTION

A corner shelf system for storing and displaying consumer electronic source components and other objects is disclosed.

The corner shelf system may include a support assembly and a non-rectangular shelf. The support assembly may include two or more support members and a ratchet mechanism. The shelf may support one or more consumer electronic source components.

DETAILED DESCRIPTION

Figure 1A:
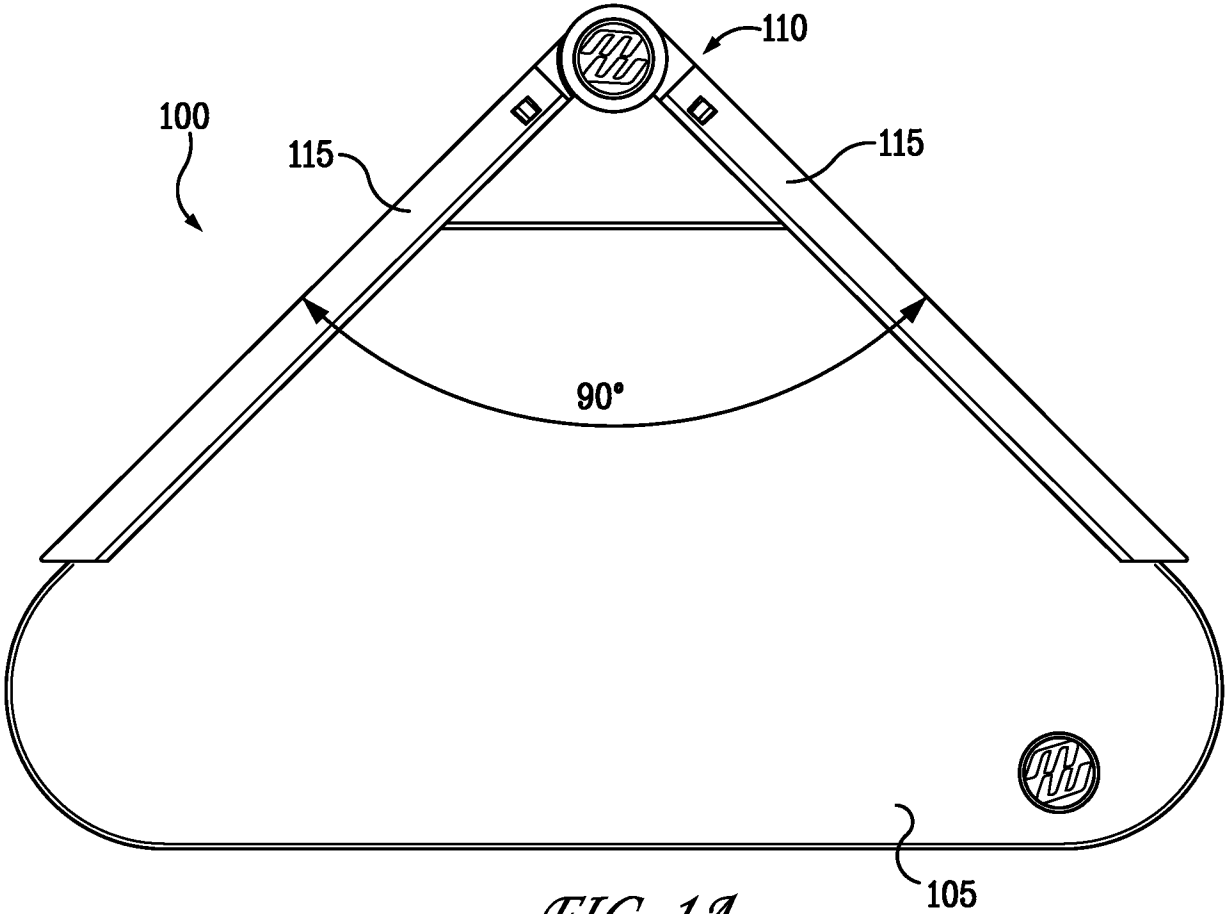
FIG. 1A is a top view of an exemplary corner shelf system.

A corner shelf system for storing and displaying consumer electronic source components and other objects is disclosed. Such consumer electronic source components may include set-top boxes, optical disc players, stereo receivers, gaming systems, and any other source component that a consumer might wish to connect to a nearby flat panel display. The corner shelf system may fit flushly within the corner of a room. As a result, it may be placed directly above or below a corner-mounted flat panel display. Because the corner shelf system may be centered with the flat panel display, the infrared remote control sensors of any source components stored on the shelf may be aligned with the infrared remote control sensor of the flat panel display. Accordingly, the corner shelf system may eliminate the need for users to deal with the "multiple lines of site" problem that often arises when source components are stored on an standard single-wall shelf or other surface that is offset from the corner-mounted flat panel display.

The corner shelf system may also feature a ratchet mechanism through which the members that support the shelf may be coupled. The ratchet mechanism may provide the support assembly with enhanced strength and stability by providing torsional support. If the weight of a source component is unproportionally distributed to one support member, the ratchet mechanism may disperse some of the load to the one or more other support members. The ratchet mechanism may also allow the angle between the support members to be adjustably set to various angles between about 0° and about 90°. In some embodiments, the angle may be adjustable beyond 90° to account for unconventionally obtuse room corners. Where the ratchet mechanism permits the angle to be adjusted down to about 0°, it effectively allows the support assembly to be collapsed down to a compact form that is optimal for storage and shipping. The ratchet mechanism may also greatly facilitate the user installation process. Namely, the ratchet mechanism may keep each of the support members aligned at the same height with respect to the ratchet mechanism. In effect, the ratchet mechanism may automatically ensure that the various support members are substantially level with respect to one another so that the shelf, too, is substantially level when installed into the support assembly.

Moreover, because the ratchet mechanism may permit the support assembly to be shipped to consumers in a pre-assembled, compact form (i.e., wherein the support members are already coupled to the ratchet mechanism and the angle between the support members has been collapsed down to about 0°), a consumer need not worry about individually installing multiple support members. As a result, the installation process may be easier and faster than those associated with existing corner shelves.

The corner shelf system may also include a space between the shelf and the support assembly. The space may result in improved cable management by allowing cables to run downwardly between the support members rather than occupying shelf space and extending around a support member in an awkward and unsightly manner.

Although certain embodiments of a corner shelf system are discussed herein, it should be understood that such embodiments are exemplary only and in no way limit the scope of the present disclosure. Persons of ordinary skill in the art will readily recognize that the present disclosure suggests many other possible embodiments in addition to those expressly described herein. For instance, although embodiments are described in the context of supporting consumer electronic source components, it should be readily apparent to persons of ordinary skill in the art that the superior weight-bearing capability of the corner shelf system disclosed herein makes it equally suitable for storing and displaying other objects that are too heavy to be supported by known corner shelves, such as sculptures, vases, textbooks, or chests, to name a few.

FIG. 1A is a top view of an exemplary corner shelf. As shown in FIG. 1A, a corner shelf system 100 may include a shelf 105 and a support assembly 110. Shelf 105 may be any shape suitable for fitting into a corner. For instance, shelf 105 may be non-rectangular. Shelf 105 may have an upper surface area large enough to accommodate one or more consumer electronic source components. For example, in one embodiment, shelf 105 may have a width of at least twenty-five inches and a length of at least twelve inches. Shelf 105 may include or be made from any rigid material, such as glass, plastic, metal, or wood. Where glass is used, shelf 105 may be tempered for enhanced strength, thermal resistance, and aesthetic appeal. In such cases, shelf 105 may be manufactured by cutting a glass sheet to desired dimensions, polishing the edges of the sheet, and heat-treating the glass according to well-known tempering techniques. Support assembly 110 may include at least two support members 115. In some embodiments, support assembly 110 may include no more than two support members 115. Support members 115 may be coupled at about a 90° angle such that support assembly 110 fits flush against a conventional room corner.

Figure 1B:
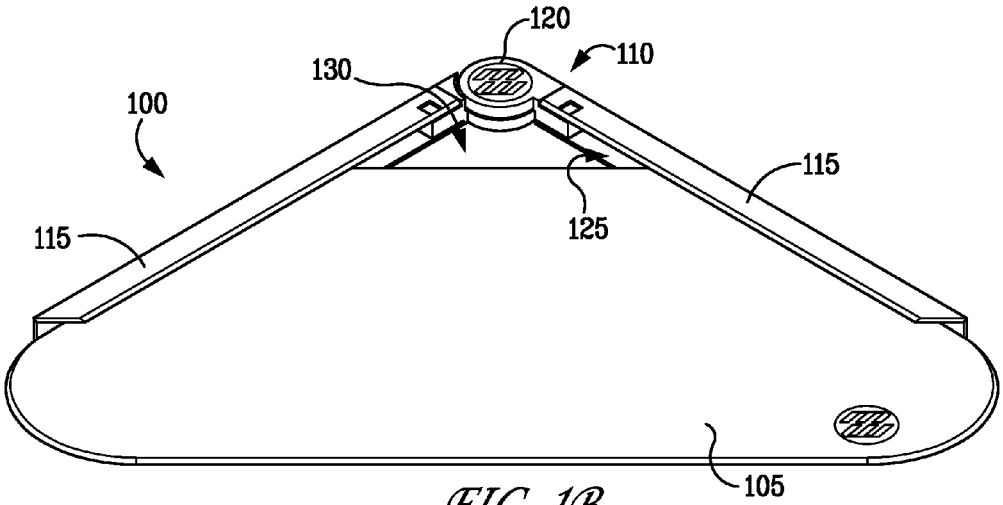
FIG. 1B is a top-down perspective view of the exemplary corner shelf system of FIG. 1A.

FIG. 1B is a top-down, perspective view of the exemplary corner shelf of FIG. 1A. In addition to support members 115, support assembly 110 may include a ratchet mechanism 120. Support members 115 may be coupled together by ratchet mechanism 120. The about 90° angle at which support members 115 may be coupled may be adjustable by way of ratchet mechanism 120. In some embodiments, the angle may be adjustable down to about 0° such that support members 115 are oriented substantially parallel with one another. When coupled together by ratchet mechanism 120, support members 115 may be disposed at about the same height with respect to the ratchet mechanism. In such embodiments, adjusting the angle at which support members 115 are coupled by way of ratchet mechanism 120 may not alter the height of support members 115 with respect to ratchet mechanism 120. Ratchet mechanism 120 may be manufactured using injection tooling. The injected parts for ratchet mechanism 120 may be produced using metal, plastic, or any other rigid, injectable material. Support members 115 may each include a channel 125 that slideably receives an edge of shelf 105. Corner shelf system 100 may further include a space 130 between shelf 105 and a portion of support assembly 110.

Figure 2:
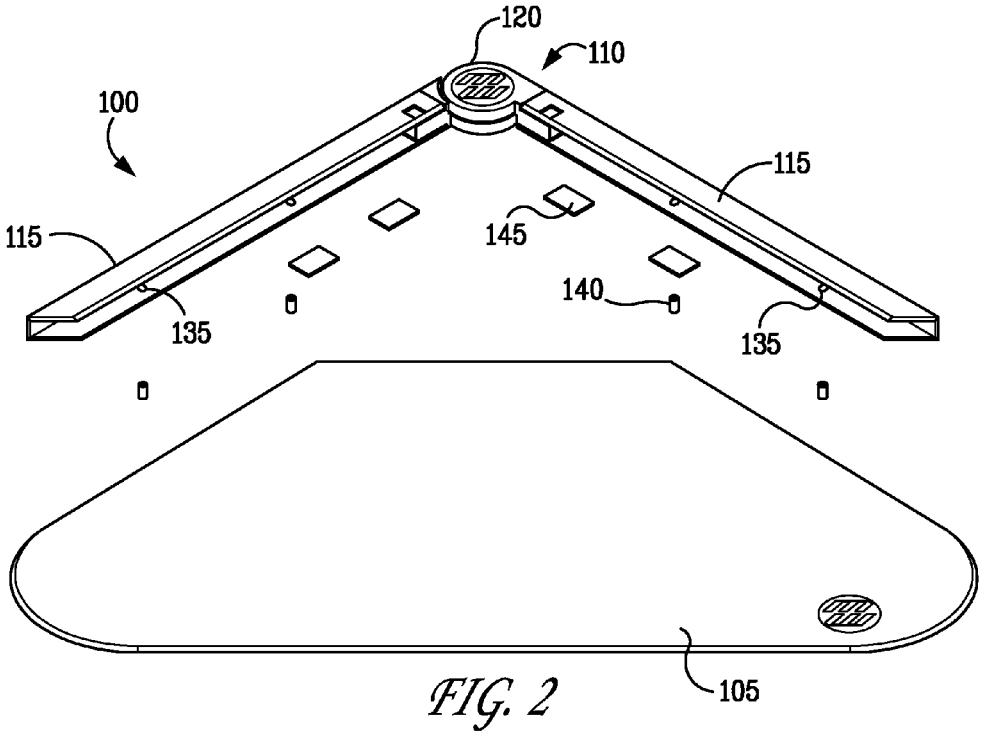
FIG. 2 is a top-down, partially exploded perspective view of the exemplary corner shelf system of FIG. 1A.

FIG. 2 is a top-down, partially exploded perspective view of the exemplary corner shelf system of FIG. 1A. As shown in FIG. 2, one or more of support members 115 may include one or more holes or voids 135 that receive coupling hardware 140. Coupling hardware 140 may be a set screw, a pin, a dowel, or any other suitable fastener. Coupling hardware 140 may include or be made from nylon. Where support members 115 each include a channel 125 that slideably receives an edge of shelf 105, each support member 115 may receive one or more pads 145 within channel 125. Pads 145 may include or be made from rubber, cloth, plastic, or any other suitable material that may facilitate friction between shelf 105 and pads 145 and, in turn, between pads 145 and channel 125. Both coupling hardware 140 and pads 145 may facilitate keeping shelf 105 of FIG. 1A securely coupled to support members 115. Holes or voids 135 may be disposed on the surface bottom-most surface of each support member 115 so as to remain substantially hidden from view. As a result, corner shelf system 100 may maintain a sleek, low profile design that is free of unsightly, protruding hardware.

Figure 3:
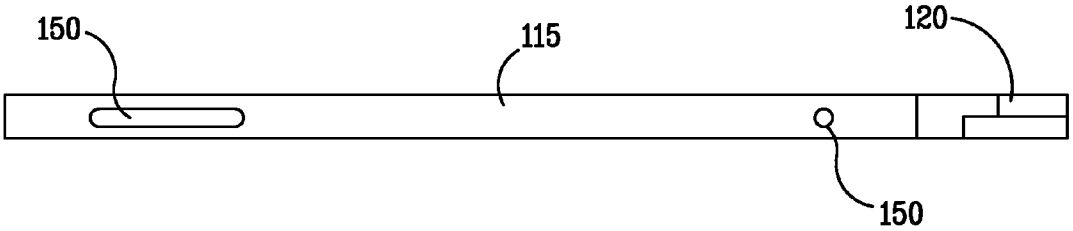
FIG. 3 is a side view of an exemplary support member of FIG. 1A.

FIG. 3 is a side view of the exemplary support member of FIG. 1A. Support member 115 may include one or more holes or voids 150 that receive mounting hardware such as wall screw, bolts, concrete or drywall anchors, or other suitable fasteners. Any such hardware may be accompanied by appropriately sized washers. The mounting hardware may facilitate keeping the corner shelf system securely mounted to the two walls forming the corner in which the system is installed. In one exemplary embodiment, support member 115 may have a height of about 0.8 inches, thereby further contributing to the low profile characteristic of both support member 115 and the overall corner shelf system 100. Among other suitable, well-known methods, support member 115 may be manufactured using conventional extrusion techniques. Support member 115 may include or be made from any rigid material, such as glass, plastic, metal, or wood. For instance, in one embodiment, support member 115 may be made of 3.5 mm thick extruded aluminum.

Figure 4:
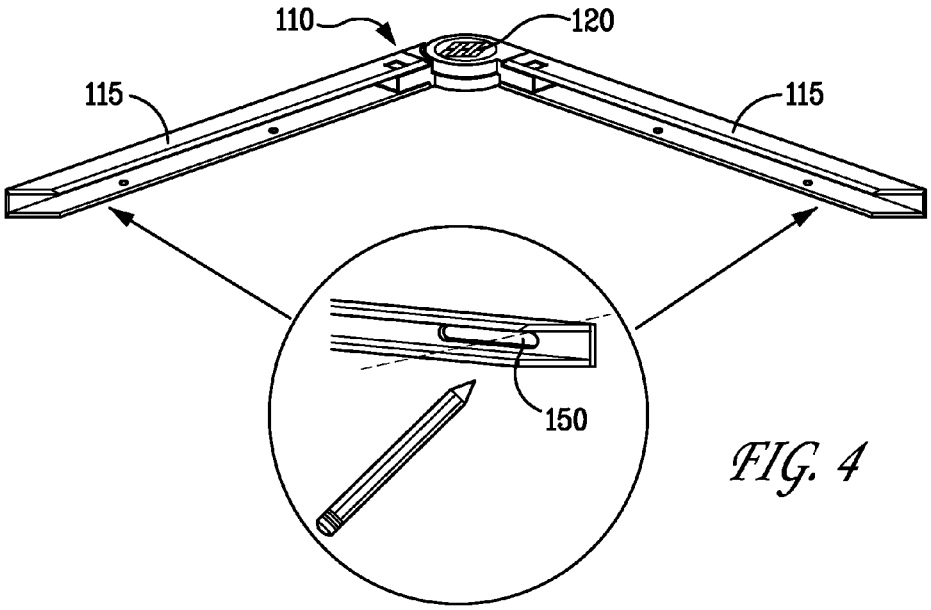
FIG. 4 is a top-down perspective view of the exemplary support assembly of FIG. 1A.

FIG. 4 is a top-down perspective view of the exemplary support assembly of FIG. 1A. In operation, as illustrated with respect to the exemplary embodiment shown in FIG. 4, a user first positions support assembly 110 in a room corner at a desired height from the floor. The user then adjusts the angle between support members 115 until each support member 115 is positioned flat against one of the two walls forming the corner. Next, the user confirms that support members 115 are level using a leveling tool (not shown). The user then uses a marking tool, such as a pencil, to mark the location at which mounting hardware should be installed through hole or void 150 of each support member 115.

Figure 5:
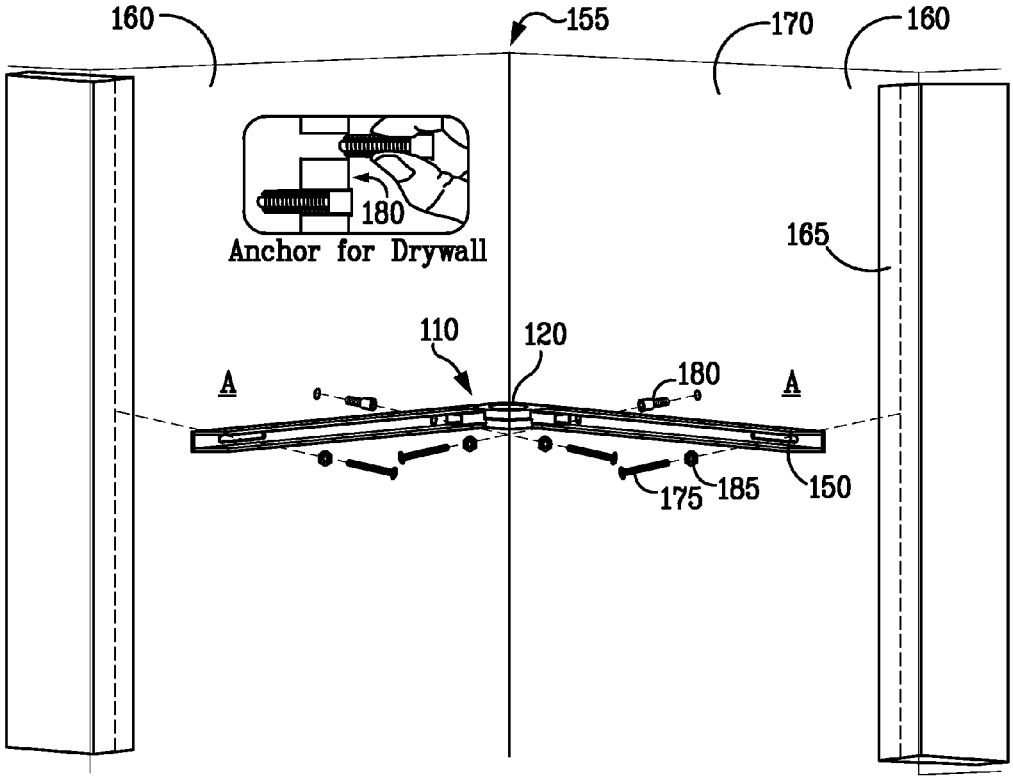
FIG. 5 is a partially exploded front view of the exemplary support assembly of FIG. 1A disposed in a room corner.

FIG. 5 is a partially exploded front view of the exemplary support assembly of FIG. 1A disposed in a room corner. Corner shelf system 100 may mounted to a wall comprising wood studs and drywall, a wall solely comprising drywall, a concrete wall, or any other type of wall. For illustrative purposes, FIG. 5 depicts a room corner 155 formed from walls 160 that are each comprised of both wood studs 165 and drywall 170. As shown in FIG. 5, following the exemplary operational steps illustrated in FIG. 4, the user employs conventional mounting techniques to mount each support member 115 to one of the two walls 160 forming corner 155. In accordance with such well-known techniques, where hole or void 150 of support member 150 may be positioned over a wood stud 165, mounting hardware such as wall screw 175 may be screwed directly into wall 160. Where hole or void 150 of support member 150 cannot be positioned over a wood stud 165, where wall 160 does not contain a wood stud 165, or where wall 160 is a concrete wall, mounting hardware such as wall screw 175 may need to be accompanied by an appropriate anchor 180, such as a drywall or concrete anchor. Washers 185 may be used to distribute the load of the mounting hardware.

Figure 6:
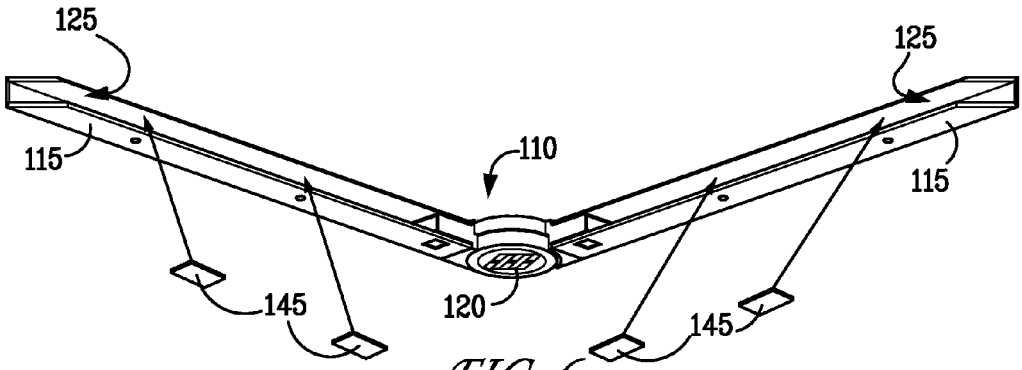
FIG. 6 is a bottom-up, partially exploded perspective view of the exemplary support assembly of FIG. 1A.

FIG. 6 is a bottom-up, partially exploded perspective view of the exemplary support assembly of FIG. 1A. As shown in FIG. 6, following the exemplary operational steps illustrated in FIG. 5, the user then places one or more pads 145 within each channel 125 of support member 115.

Figure 7:
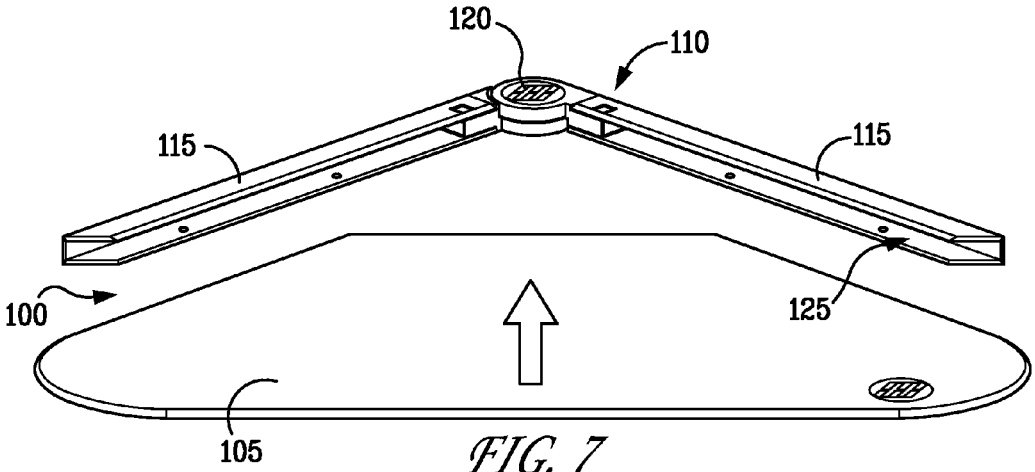
FIG. 7 is a top-down, partially exploded perspective view of the exemplary corner shelf system of FIG. 1A.

FIG. 7 is a top-down, partially exploded perspective view of the exemplary corner shelf system of FIG. 1A. As shown in FIG. 7, following the exemplary operational step illustrated in FIG. 6, the user then positions shelf 105 within support assembly 110 by sliding the two lateral edges of shelf 105 into corresponding channels 125 of support members 115. Once shelf 105 is in place, frictional forces imparted by pads 145 (shown in FIG. 6) may prevent shelf 105 from undesirably shifting during normal use. Pads 145 may further prevent the surfaces and/or edges of channel 125 from scratching shelf 105.

Figure 8:
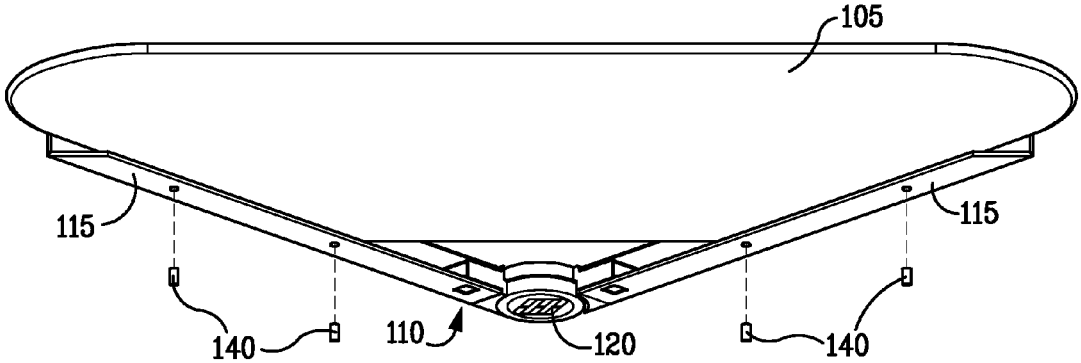
FIG. 8 is a bottom-up, partially exploded perspective view of the exemplary corner shelf system of FIG. 1A.

FIG. 8 is a bottom-up, partially exploded perspective view of the exemplary corner shelf system of FIG. 1A. As shown in FIG. 8, following the exemplary operational step illustrated in FIG. 7, the user then inserts coupling hardware 140 into holes or voids 135 and tightens coupling hardware 140 until shelf 105 is tensioned in place within channels 125 of support members 115. Lastly, the user places one or more consumer electronic source components or other objects upon shelf 105.

The above description is illustrative and should not be interpreted as restricted to the particular embodiments mentioned herein, which were selected so as to most clearly illustrate the inventive concepts. Many variations of the corner shelf system disclosed herein will become apparent to those of skill in the art upon review of this disclosure. The present descriptions are intended to cover alternatives, modifications, and equivalents as may be included within the spirit and scope of the invention defined by the appended claims and otherwise appreciated by one of ordinary skill in the art.

What is claimed is:

1. A corner shelf system, comprising:

a support assembly, the support assembly including a set of support members and a ratchet mechanism, the set of support members consisting of two support members, the two support members coupled at a 90° angle by the ratchet mechanism, the 90° angle being adjustable down to 0° by way of the ratchet mechanism such that the two support members are parallel with one another, the two support members each including a top surface, a bottom surface, a side surface, a channel disposed between the top surface and the bottom surface, and a plurality of voids disposed in the bottom surface;

a non-rectangular shelf having a plurality of edges, two of the edges each being slideably mated with one of the channels in the support members;

a pad disposed within the channel of each support member, the pad enhancing friction between the non-rectangular shelf and the support member; and coupling hardware upwardly disposed within the voids in the bottom surface of each support member, the coupling hardware being hidden from view such that the top surface of each support member remains free of the voids and the coupling hardware.

2. The corner shelf system of claim 1, wherein the two support members are disposed at about the same height with respect to the ratchet mechanism when coupled together by the ratchet mechanism.

3. The corner shelf system of claim 1, wherein adjusting the angle at which the two support members are coupled by way of the ratchet mechanism does not alter the height of the support members with respect to the ratchet mechanism.

4. The corner shelf system of claim 1, further comprising a space between the shelf and a portion of the support assembly.

5. The corner shelf system of claim 1, wherein a region of the shelf has a width of at least twenty-five inches.

6. The corner shelf system of claim 1, wherein a region of the shelf has a length of at least twelve inches.

7. The corner shelf system of claim 1, wherein the shelf is a sheet of tempered glass.

8. The corner shelf system of claim 1, wherein the shelf includes plastic.

9. The corner shelf system of claim 1, wherein the shelf includes metal.

10. The corner shelf system of claim 1, wherein the shelf includes wood.

11. A corner shelf system, comprising:

a support assembly, the support assembly including a set of support members and a ratchet mechanism, the set of support members consisting of two support members, the two support members coupled at a 90° angle by the ratchet mechanism, the 90° angle being adjustable down to 0° by way of the ratchet mechanism such that the two support members are parallel with one another, the two support members each including a top surface, a bottom surface, a side surface, a channel disposed between the top surface and the bottom surface, and a plurality of voids disposed in the bottom surface;

a non-rectangular shelf that supports consumer electronic source components, the shelf having a plurality of edges, two of the edges each being slideably mated with one of the channels in the support members; and coupling hardware upwardly disposed within the voids in the bottom surface of each support member, the coupling hardware being hidden from view such that the top surface of each support member remains free of the voids and the coupling hardware.

12. The corner shelf system of claim 11, wherein the two support members are disposed at about the same height with respect to the ratchet mechanism when coupled together by the ratchet mechanism.

13. The corner shelf system of claim 11, wherein adjusting the angle at which the two support members are coupled by way of the ratchet mechanism does not alter the height of the support members with respect to the ratchet mechanism.

14. The corner shelf system of claim 11, further comprising a space between the shelf and a portion of the support assembly.

15. The corner shelf system of claim 11, wherein the shelf is a sheet of tempered glass.

16. A corner shelf system, comprising:

a support assembly, the support assembly including two support members and a ratchet mechanism, the two support members coupled at a 90° angle by the ratchet mechanism, the 90° angle being adjustable down to 0° by way of the ratchet mechanism such that the two support members are parallel with one another, the two support members each including a top surface, a bottom surface, a side surface, a channel disposed between the top surface and the bottom surface, and a plurality of voids disposed in the bottom surface;

a non-rectangular shelf that supports consumer electronic source components, the shelf having a plurality of edges, two of the edges each being slideably mated with one of the channels in the support members;

a pad disposed within the channel of each support member, the pad enhancing friction between the non-rectangular shelf and the support member; and coupling hardware upwardly disposed within the voids in the bottom surface of each support member, the coupling hardware being hidden from view such that the top surface of each support member remains free of the voids and the coupling hardware.

17. The corner shelf system of claim 16, wherein the two support members are disposed at about the same height with respect to the ratchet mechanism when coupled together by the ratchet mechanism.

18. The corner shelf system of claim 16, wherein adjusting the angle at which the two support members are coupled by way of the ratchet mechanism does not alter the height of the support members with respect to the ratchet mechanism.

19. The corner shelf system of claim 16, further comprising a space between the shelf and a portion of the support assembly.

20. The corner shelf system of claim 16, wherein the shelf is a sheet of tempered glass.

* * * * *